US011426964B2

(12) United States Patent
Chiari

(10) Patent No.: US 11,426,964 B2
(45) Date of Patent: Aug. 30, 2022

(54) DEVICE FOR RUPTURING ATTACHMENT ZONES ON FOLDING BOXES AND PRODUCTION UNIT COMPRISING SUCH A RUPTURE DEVICE

(71) Applicant: Bobst Lyon, Villeurbanne (FR)

(72) Inventor: Mauro Chiari, Denges (CH)

(73) Assignee: BOBST LYON

( * ) Notice: Subject to any disclaimer, the term of this patent is extended or adjusted under 35 U.S.C. 154(b) by 112 days.

(21) Appl. No.: 16/094,009

(22) PCT Filed: Apr. 5, 2017

(86) PCT No.: PCT/EP2017/025078
§ 371 (c)(1),
(2) Date: Oct. 16, 2018

(87) PCT Pub. No.: WO2017/182137
PCT Pub. Date: Oct. 26, 2017

(65) Prior Publication Data

US 2019/0111648 A1 Apr. 18, 2019

(30) Foreign Application Priority Data

Apr. 18, 2016 (FR) ..... 16 53390

(51) Int. Cl.
*B26D 7/06* (2006.01)
*B26D 7/18* (2006.01)
(Continued)

(52) U.S. Cl.
CPC ..... *B31B 50/002* (2017.08); *B26D 7/0625* (2013.01); *B26D 7/18* (2013.01);
(Continued)

(58) Field of Classification Search
CPC .... B26D 7/015; B26D 7/1827; B26D 7/1836; B26D 2007/1881; B26D 7/025; B26D 7/04; B26F 3/002; B26F 3/02; B65D 7/1827
(Continued)

(56) References Cited

U.S. PATENT DOCUMENTS 3,746,146 A * 7/1973 Buchheit ..... B21B 43/02 198/774.4
4,136,604 A * 1/1979 Schmidt ..... B26D 7/1827 225/101
(Continued)

FOREIGN PATENT DOCUMENTS

FR 2 527 189 A1 11/1983
WO WO 2008/129579 A2 10/2008

OTHER PUBLICATIONS

International Search Report dated Sep. 7, 2017 in corresponding PCT International Application No. PCT/EP2017/025078.
(Continued)

*Primary Examiner* — Thanh K Truong
*Assistant Examiner* — Patrick B Fry
(74) *Attorney, Agent, or Firm* — Ostrolenk Faber LLP

(57) ABSTRACT

This severing device (1) includes an upper pressing member (2), a pile support part (4) having a plurality of conveying members (10) for conveying the pile in a conveying direction (X), a lower pressing member (6) arranged under the conveying members (10). The conveying members (10) are juxtaposed in a transverse direction. Two juxtaposed conveying members can be parted. The lower pressing member (6) has: i) two adjacent lower plates (6.1, 6.2) that can be moved apart, and ii) a lower translation actuator (6.3) for moving the lower plates (6.1, 6.2) so as to cause the severance slot (2.0) between juxtaposed conveying members to coincide with a frangible line in the plate.

13 Claims, 6 Drawing Sheets

(51) Int. Cl.

| | |
|---|---|
| ***B26F 3/02*** | (2006.01) |
| ***B31B 50/00*** | (2017.01) |
| ***B31B 50/04*** | (2017.01) |
| ***B31B 50/06*** | (2017.01) |
| *B31B 120/30* | (2017.01) |
| *B31B 110/35* | (2017.01) |

(52) U.S. Cl.
CPC ..... *B26F 3/02* (2013.01); *B31B 50/006* (2017.08); *B31B 50/042* (2017.08); *B31B 50/06* (2017.08); *B31B 2110/35* (2017.08); *B31B 2120/302* (2017.08)

(58) Field of Classification Search
USPC ..... 225/97, 100, 101, 104, 105; 198/607
See application file for complete search history.

(56) References Cited

U.S. PATENT DOCUMENTS 4,500,022 A * 2/1985 Lucas ..... B26D 7/1827 225/101
4,511,028 A * 4/1985 Meister ..... B65G 23/22 198/497
4,998,399 A * 3/1991 Lutzke ..... B65B 21/06 198/419.3
5,201,823 A * 4/1993 Pazdernik ..... B65G 47/29 198/419.3
5,405,240 A * 4/1995 Uno ..... B65G 57/32 414/331.04
5,791,539 A * 8/1998 Shill ..... B26D 7/1827 225/1
5,927,582 A * 7/1999 Duecker ..... B26D 7/1827 225/2
6,776,748 B2 * 8/2004 Joux ..... B26D 7/1827 225/101
6,796,553 B2 * 9/2004 Hampel ..... B42C 11/04 270/52.18
8,668,193 B2 * 3/2014 Sasaki ..... B42B 4/00 270/58.07
9,315,339 B2 * 4/2016 Gaillard ..... B65G 23/26
2014/0346011 A1 * 11/2014 Gaillard ..... B65G 47/682 198/426

OTHER PUBLICATIONS

Written Opinion dated Sep. 7, 2017 in corresponding PCT International Application No. PCT/EP2017/025078.

* cited by examiner

DEVICE FOR RUPTURING ATTACHMENT ZONES ON FOLDING BOXES AND PRODUCTION UNIT COMPRISING SUCH A RUPTURE DEVICE

CROSS-REFERENCE TO RELATED APPLICATIONS

The present application is a 35 U.S.C. §§ 371 national phase conversion of PCT/EP2017/025078, filed Apr. 5, 2017, which claims priority of French Patent Application No. 16 53390, filed Apr. 18, 2016, the contents of which are incorporated by reference herein. The PCT International Application was published in the French language.

TECHNICAL FIELD

The present invention relates to a severing device for severing attachment zones defining frangible lines on stacked sheets of cardboard.

The present invention applies to the field of the manufacture of collapsible boxes made from sheets of cardboard. A collapsible box may for example be a packing case. In general, such sheets of cardboard are precut when stacked. The precutting produces on each sheet of cardboard a frangible line defined by attachment zones.

Prior Art

The document FR 2527189 describes a severing device for severing attachment zones defining frangible lines on stacked sheets of cardboard forming a pile. The severing device of FR 2527189 comprises:

- an upper pressing member which is mobile between an immobilizing position, in which it immobilizes the pile, and a clear position, in which it is distant from the pile; and
- a lower part configured to support and convey the pile when the upper pressing member is in the immobilizing position.

The lower part comprises a conveyor including a multitude of rollers configured to move the pile in the conveying direction.

However, because each roller needs to be relatively narrow, the pressure of the pile on the rollers carries the risk of causing deep marks at least on the underside of the pile. Because of these marks, at least the bottom sheet of each pile exhibits a quality defect that requires it to be scrapped, thereby increasing the level of waste and the production cost.

SUMMARY OF THE INVENTION

It is an object of the present invention to solve the aforementioned problems, completely or in part.

To this end, one subject of the present invention is a severing device, for severing attachment zones defining frangible lines on stacked sheets of cardboard forming a pile, the severing device comprising at least:

- an upper pressing member which is mobile at least between:
  - an immobilizing position, in which the upper pressing member applies pressure to the top sheet of the pile, so as to immobilize the pile, and
  - a clear position, in which the upper pressing member is arranged in such a way as to be distant from the top sheet of the pile; and

- a support part configured to support the pile when the upper pressing member is in the immobilizing position, the support part comprising a plurality of conveying members configured to convey and move the pile in a conveying direction, the severing device comprising:

- the conveying members are juxtaposed in a transverse direction which extends transversely to the conveying direction, the conveying members are configured in such a way that two juxtaposed conveying members are movable relative to one another in the transverse direction, several conveying members each include: i) a belt extending parallel to the conveying direction and configured to drive the pile in the conveying direction, ii) at least one rotary pinion configured to drive the belt in a belt circuit, and
- a lower pressing member arranged under the conveying members, and the conveying members being mobile at least between:
  - an immobilizing position, in which the lower pressing member applies pressure to the undersides of the conveying members so that the conveying members immobilize the pile, and
  - a clear position, in which the lower pressing member is arranged in such a way as to be distant from the undersides of the conveying members;

the lower pressing member comprising:

i) two adjacent lower plates that can be moved apart in the transverse direction so as to define a severance slot, and ii) a lower translation actuator arranged to move the lower plates in translation in the transverse direction, so as to cause the severance slot to coincide with a frangible line.

Thus, such a severing device allows the frangible lines to be severed at different positions in the transverse direction without marking the bottom sheet of the pile. This is because the belts of the conveying members are relatively broad, and this spreads the pressure of the lower pressing member over a relatively large area and therefore minimizes the risk of marking the bottom sheet of the pile.

According to an alternative, several conveying members each have an elongate shape with a ratio of width to length less than 10%, or even less than 5%. This elongate shape is, for example, rectilinear and rectangular.

According to an alternative form, the transverse direction is orthogonal to the conveying direction. Thus, such lower pressing members make it possible to sever attachment zones that form rectilinear frangible lines. The conveying direction may be horizontal when the severing device is in the service configuration.

According to an alternative form, the lower translation actuator comprises a rack mechanism and rack rails.

According to an alternative form, the lower ram is a linear actuator, for example a ram. The linear actuator may be moved by electrical, pneumatic or hydraulic power.

The belt conveying members allow piles to be conveyed effectively into the severing device and allow the attachment zones to be severed along the frangible lines.

According to an alternative form, each conveying member includes such a belt and at least one such rotary pinion.

According to an alternative form, conveying members each comprise two rotary pinions situated respectively at the two ends of the conveying member in the conveying direction.

As an alternative to this embodiment, several conveying members may, instead of belts, comprise series of wheels or series of rollers configured to drive the pile in the conveying direction.

According to one embodiment, the number of conveying members is greater than eight, preferably greater than sixteen.

According to one embodiment, each conveying member is movable in the transverse direction with respect to a juxtaposed conveying member.

Thus, such a severing device allows a great many frangible lines to be severed at different positions in the transverse direction, thereby simplifying the conveying of the pile upstream of the severing device and avoiding the need to reposition in a single severing zone a pile that has several frangible lines.

According to one embodiment, several conveying members each have a width comprised between 50 mm and 500 mm, preferably between 50 mm and 200 mm, measured in the transverse direction.

Thus, such widths allows numerous conveying members to be juxtaposed, so as to define numerous severing zones, and therefore so as to be able to sever numerous frangible lines.

In other words, each of these conveying members is narrow in comparison with the conveying members of the prior art.

According to one embodiment, the upper pressing member is mobile, between its immobilizing position and its clear position, in a substantially vertical direction when the severing device is in the service configuration, and the conveying members are mobile, between the immobilizing positions and the clear positions, in a substantially vertical direction when the severing device is in the service configuration.

For the upper pressing member, the clear position is situated above the immobilizing position, whereas for the lower pressing member, the clear position is situated below the immobilizing position.

According to one embodiment, the upper pressing member comprises a pivoting part, the severing device further comprising a pivoting actuator configured to drive the pivoting part about a direction of pivoting parallel to the transverse direction, so as to sever attachment zones defining frangible columns in the sheets of cardboard of the pile, the frangible columns extending transversely to the frangible lines.

Thus, such a severing device allows attachment zones to be severed in two perpendicular directions, along the frangible lines and frangible columns.

According to one embodiment, the upper pressing member comprises at least two adjacent upper plates that can be moved apart in the transverse direction so as to define a severance slot, the severing device further comprising an upper translation actuator designed to move the upper pressing member translationally in the transverse direction so as to cause the severance slot to coincide with a frangible line.

Thus, such adjacent plates may effectively apply pressure to the top sheet of the pile.

According to one embodiment, the upper pressing member comprises an upper ram configured to move the two upper plates apart and closer together in the transverse direction, and in which the lower pressing member comprises a lower ram configured to move the two lower plates apart and closer together in the transverse direction.

According to one embodiment, several conveying members each further include: coupling elements which are arranged on each of the transverse faces of the rotary pinion and which are configured to collaborate with coupling elements of the juxtaposed conveying member, the severing device further comprising a rotary actuator configured to drive the rotation of the rotary pinions.

According to an alternative form, the coupling elements comprise dog clutches or friction disks.

According to one embodiment, the severing device further comprises a clutch system configured to move the conveying members translationally closer together in the transverse direction.

According to one embodiment, the clutch system further comprises at least:

i) one guide rail extending in the transverse direction, ii) carriages designed to move on the at least one guide rail, each carriage being configured to support a respective conveying member, and iii) at least one electromechanical clutch configured to move a conveying member so as to move the carriages along the at least one rail.

According to one embodiment, the at least one electromechanical clutch comprises a pivoting bar designed to pivot so as to cause the conveying member to move horizontally in the transverse direction.

Moreover, another subject of the present invention is a manufacturing plant for manufacturing collapsible boxes, the manufacturing plant t comprises:

i) a severing device according to the invention, and ii) a control unit configured so as to:

receive a signal indicating the position of at least one incoming frangible line in the transverse direction, command the upper pressing member to move from the clear position into the immobilizing position, so as to immobilize the pile, command the conveying members to move from the clear positions into the immobilizing positions, so as to immobilize the pile, and part the upper plates and the lower plates in the transverse direction so as to sever the attachment zones defining the at least one frangible line.

The embodiments and alternative forms mentioned hereinabove may be considered in isolation or in any technically feasible combination.

BRIEF DESCRIPTION OF THE DRAWINGS

The present invention will be easily understood and its advantages will also become apparent from the description which will follow, which is given solely by way of nonlimiting example and makes reference to the attached figures in which identical reference signs correspond to elements that are structurally and/or functionally identical or similar. In the attached figures.

DETAILED DESCRIPTION OF PREFERRED EMBODIMENTS

Figure 10:
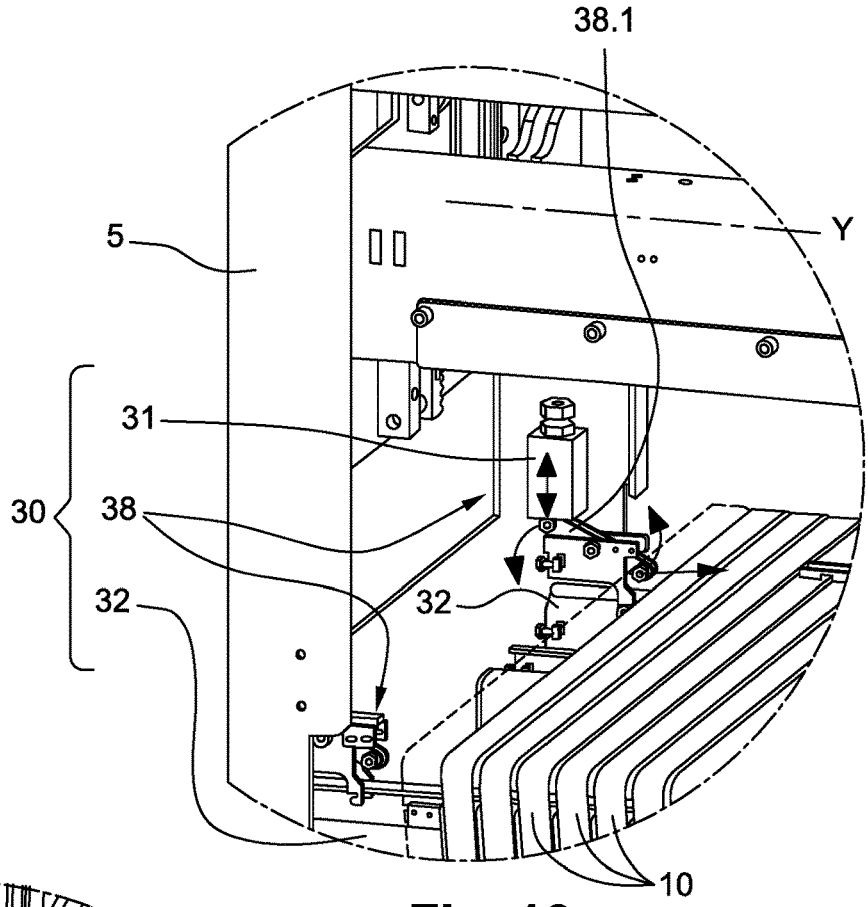
FIG. 10 a view of part of the severing device of FIG. 1, in a first configuration.
Figure 11:
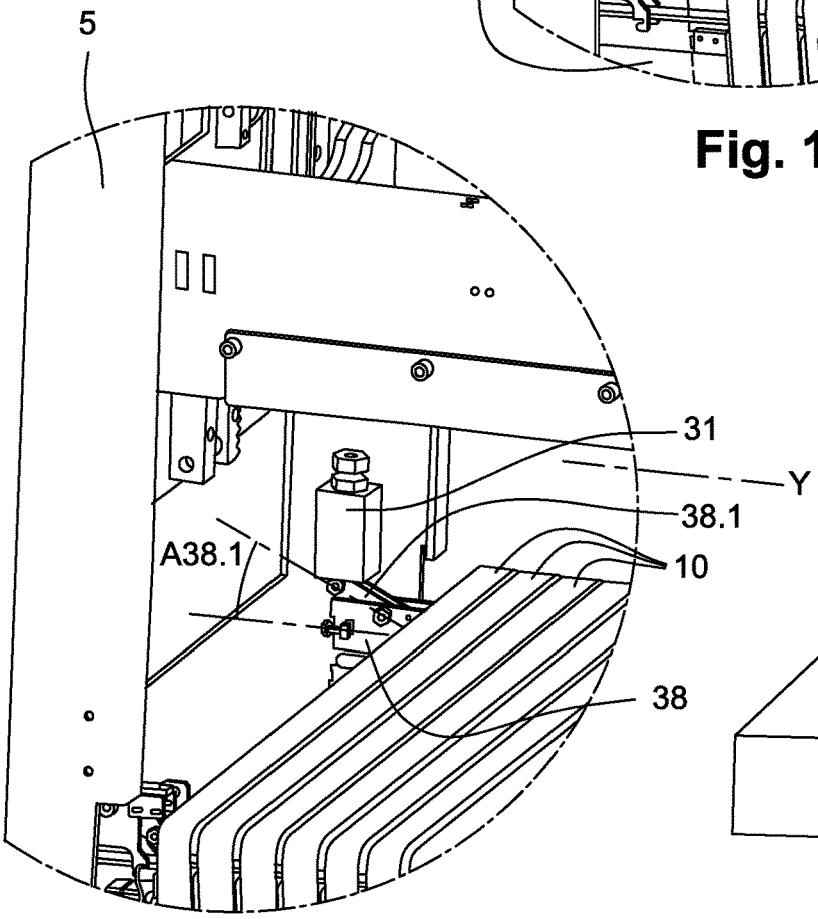
FIG. 11 is a view similar to FIG. 9 of the severing device of FIG. 9 in a second configuration.
Figure 12:
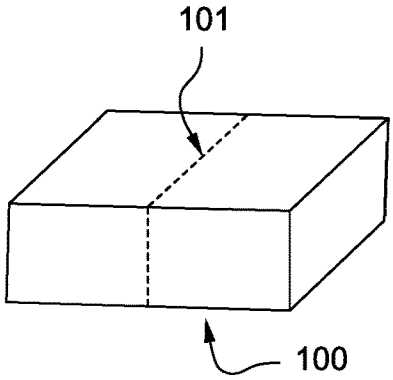
FIG. 12 is a schematic perspective view of a pile of stacked sheets of cardboard.

FIGS. 1 to 11 illustrate a severing device 1 for severing attachment zones defining frangible lines 101 on stacked sheets of cardboard forming a pile 100, visible in FIG. 12. In general, a sheet of cardboard has the overall shape of a rectangle and a pile 100 of stacked sheets of cardboard has the overall shape of a rectangular parallelepiped, as shown in FIG. 12.

The severing device 1 comprises an upper pressing member 2, a lower pressing member 6 and a support part 4. The severing device 1 further comprises a chassis 5 configured to support the upper pressing member 2, the lower pressing member 6 and the support part 4 and other components of the severing device 1.

When the severing device 1 is in the service configuration, the upper pressing member 2 is higher up than the lower pressing member 6 and the support part 4 is situated between the upper pressing member 2 and the lower pressing member 6. When the severing device 1 is in the service configuration (FIG. 1), the upper pressing member 2 is higher up in the immobilizing position than in the clear position.

The upper pressing member 2 is mobile between:

an immobilizing position, in which the upper pressing member 2 applies pressure to the top sheet of the pile, so as to immobilize the pile, and a clear position in which the upper pressing member 2 is arranged in such a way as to be distant from the top sheet of the pile.

Figure 1:
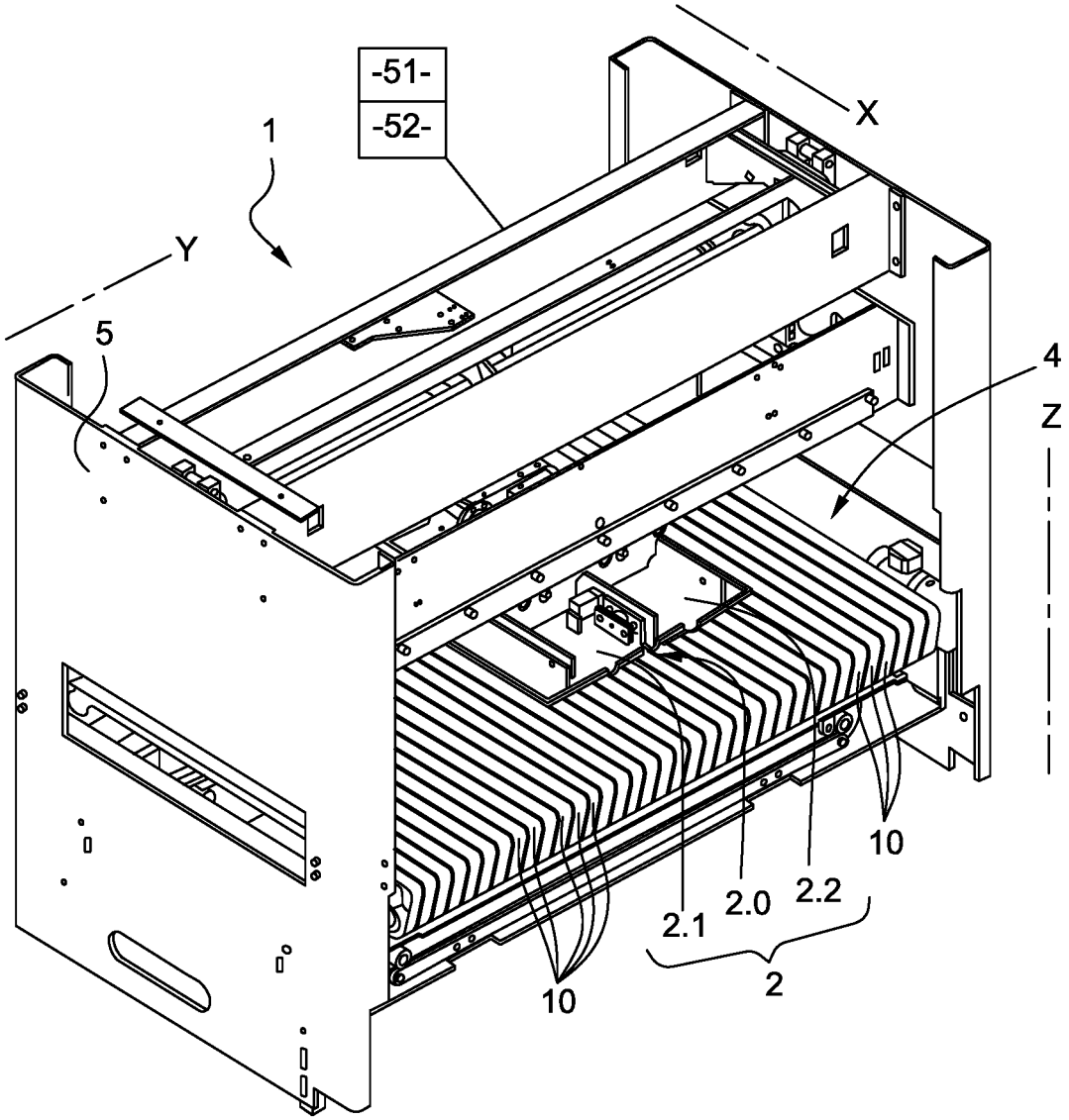
FIG. 1 is a schematic perspective assembled view of a severing device according to the invention.
Figure 2:
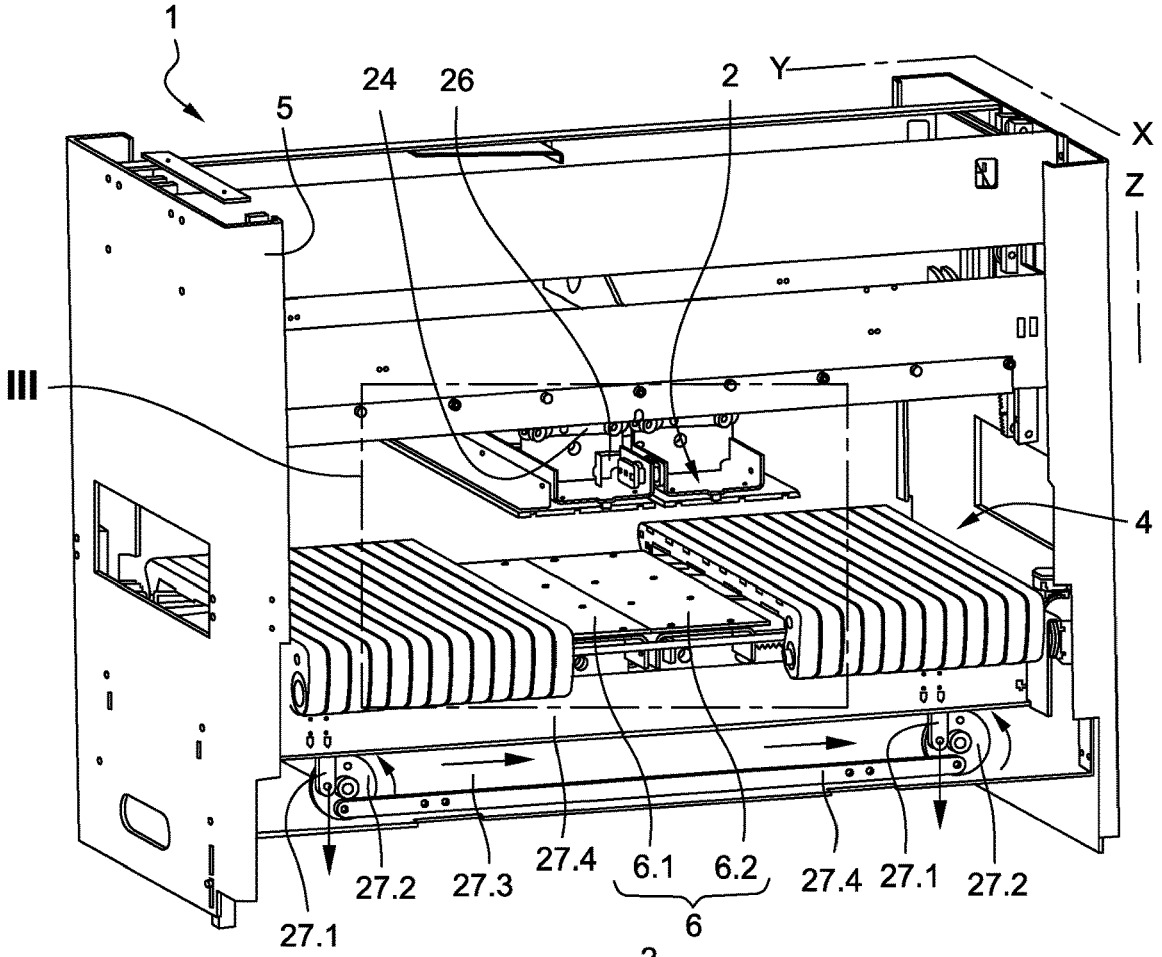
FIG. 2 is a schematic perspective view, from a different angle than FIG. 1, and with partial transparency of the severing device of FIG. 1.

In the example of the figures, the upper pressing member 2 is mobile, between its immobilizing position and its clear position, in a substantially vertical direction Z when the severing device 1 is in the service configuration (FIGS. 1 and 2).

The support part 4 is configured to support the pile when the upper pressing member 2 is in the immobilizing position. The support part 4 comprises a plurality of conveying members 10. In the example of the figures, the number of conveying members 10 is equal to 36.

The conveying members 10 are configured to convey and move the pile 100 in a conveying direction X. To this end, each conveying member 10 includes:

i) a belt 12 which extends parallel to the conveying direction X and is configured to drive the pile in the conveying direction X, and ii) rotary pinions 14 and 15 configured to drive the belt 12 in a belt circuit; the rotary pinions are situated respectively at the two ends of the conveying member 10 in the conveying direction X.

The conveying members 10 are juxtaposed in a transverse direction Y which extends transversely to the conveying direction X. The transverse direction Y here is orthogonal to the conveying direction X. The conveying direction X is horizontal when the severing device 1 is in the service configuration (FIGS. 1 and 2). The conveying direction X is usually referred to as the "running direction" and the transverse direction Y is usually referred to as the "weft direction".

The conveying members 10 are configured so that two juxtaposed conveying members 10 are movable relative to one another in the transverse direction Y. In the example of the figures, each conveying member is movable in the transverse direction Y with respect to a juxtaposed conveying member 10.

Each conveying member 10 here has a width W10 approximately equal to 50 mm, measured in the transverse direction Y. In addition, each conveying member 10 here has an elongate shape with a ratio of width W10 to length L10 approximately equal to 3.5%. The length L10 is approximately equal to 1450 mm. The elongate shape of each conveying member 10 here is rectilinear and rectangular.

Figure 3:
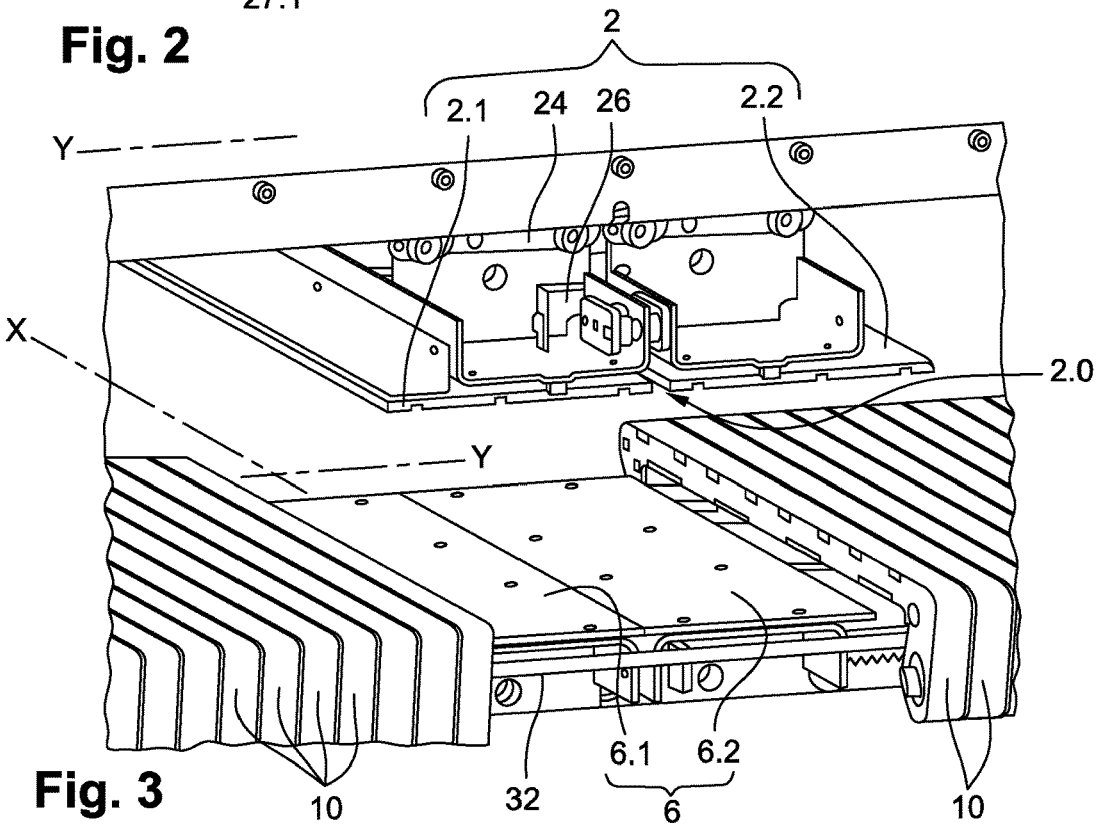
FIG. 3 is a view on a larger scale of detail III of FIG. 2.
Figure 4:
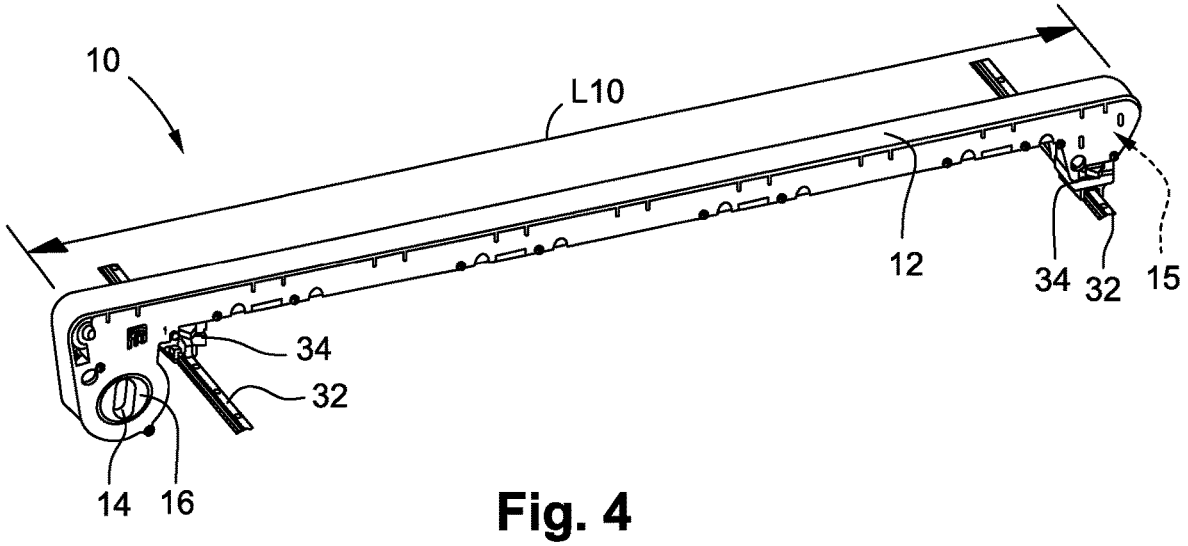
FIG. 4 is a perspective view of a conveying member belonging to the severing device of FIG. 1.
Figure 5:
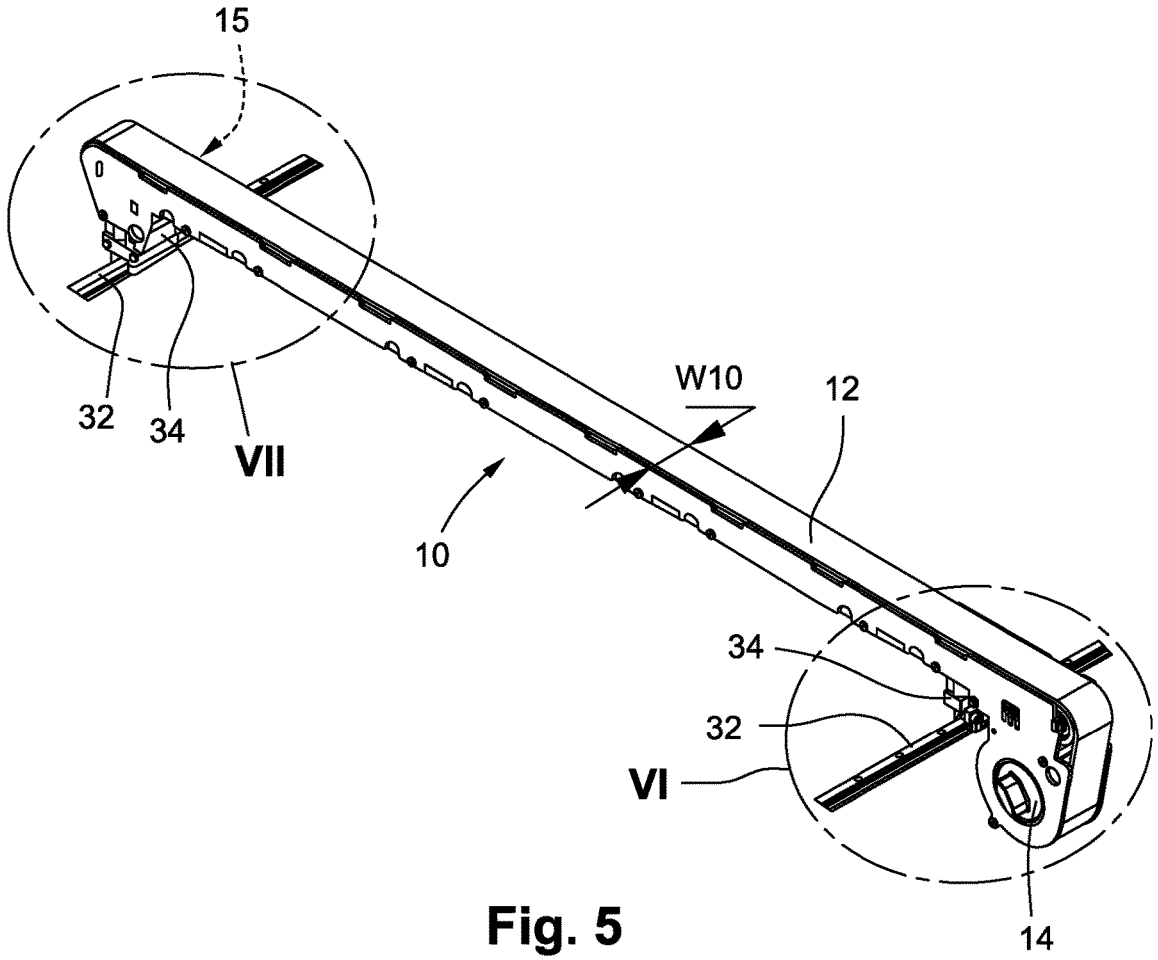
FIG. 5 is a perspective view, from a different angle than FIG. 4, of the conveying device of FIG. 4.
Figure 6:
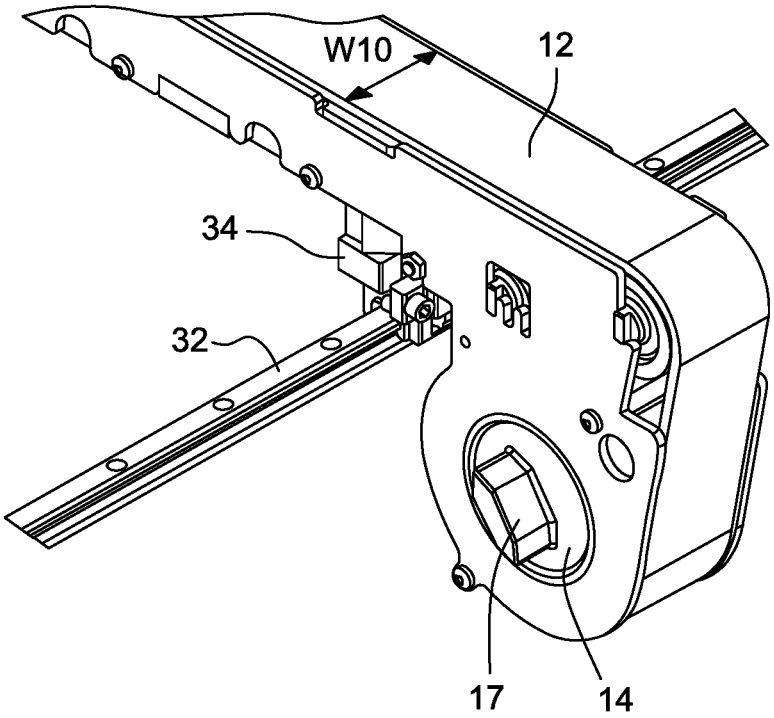
FIG. 6 is a view on a larger scale of detail VI of FIG. 5.
Figure 7:
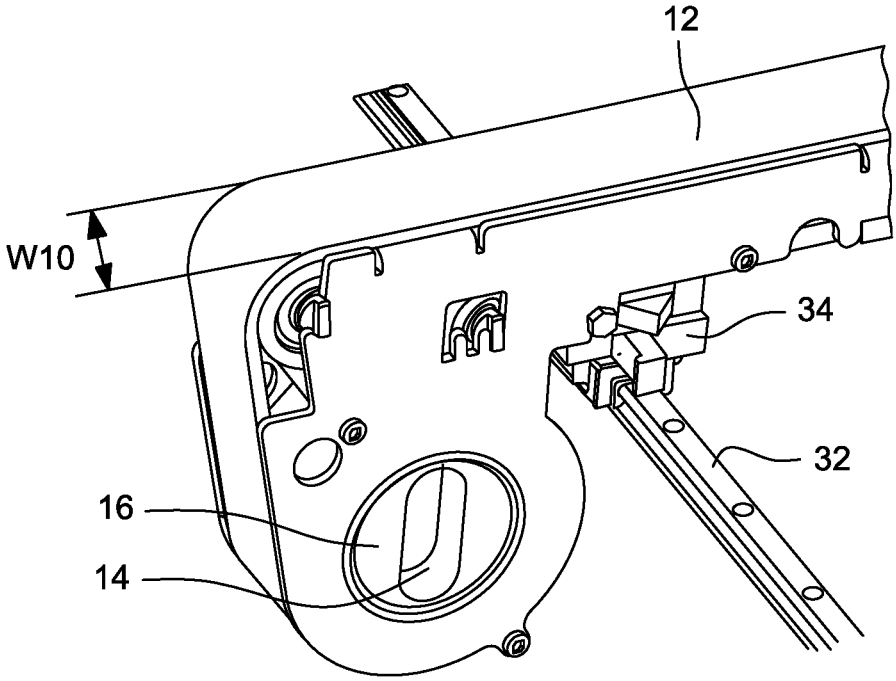
FIG. 7 is a view of detail VII of FIG. 5, on a larger scale and from a different perspective.

As FIG. 3 shows, the upper pressing member 2 comprises two adjacent upper plates 2.1, 2.2 that can be moved apart in the transverse direction Y so as to define a severance slot 2.0. The upper pressing member 2 comprises an upper ram 26 configured to selectively move the two upper plates 2.1 and 2.2 apart and closer together in the transverse direction Y.

FIG. 1 symbolically illustrates a manufacturing plant 51 for manufacturing collapsible boxes. The manufacturing plant 51 comprises: i) the severing device 1 and ii) a control unit 52 configured to control several components of the severing device 1.

When the severing device 1 has to sever frangible lines 101, the upper ram 26 moves the upper plate 2.1 away from the upper plate 2.2. The upper ram 26 then moves the upper plate 2.1 closer to the upper plate 2.2, to return to the adjacent position. The movements of the upper ram 26 are controlled by the control unit 52.

The severing device 1 further comprises an upper translation actuator 24 which is arranged to move the upper pressing member 2, namely the upper plates 2.1 and 2.2, in translation in the transverse direction Y. When the severing device 1 is in service, the upper translation actuator 24 moves the upper pressing member 2 so as to cause the severance slot 2.0 to coincide with a frangible line 101. The movements of the upper translation actuator 24 are controlled by the control unit 52.

The lower pressing member 6 is arranged underneath the conveying members 10. The conveying members 10 are mobile between:

an immobilizing position, in which the lower pressing member 6 applies pressure to the undersides of the conveying members 10, so that the conveying members 10 immobilize the pile 100, and a clear position, in which the lower pressing member 6 is arranged in such a way as to be distant from the undersides of the conveying members 10.

The conveying members 10 are mobile, between the immobilizing positions and the clear positions, in the substantially vertical direction Z when the severing device 1 is in the service configuration (FIGS. 1 and 2).

In the clear position, the belts 12 of the conveying members 10 can turn and advance, and therefore move the piles 100 in the conveying direction X. In the immobilizing position, the belts 12 cannot turn or advance, because they are in contact with the lower pressing member 6.

The severing device comprises a vertical drive system 27 which is configured to raise and lower the conveying members 10 in the vertical direction Z. The vertical drive system 27 comprises: i) vertical link rods 27.1, ii) disks 27.2 and iii) synchronizing link rods 27.3.

The vertical link rods 27.1 are secured to a frame 27.4 which supports the conveying members 10. The vertical link rods 27.1 are four in number here, two of them visible in FIG. 3.

Each disk 27.2 acts as a cam because it converts a rotational movement into a translational movement. Each vertical link rod 27.1 is connected to a respective disk 27.2 excentrically. Each synchronizing link rod 27.3 is connected excentrically to a respective disk 27.2.

The vertical drive system 27 further comprises transverse actuators, not depicted, which are configured to move the synchronizing link rods 27.3 translationally parallel to the transverse direction Y.

In service, the transverse actuators move the synchronizing link rods 27.3; the synchronizing link rods 27.3 turn the disks 27.2; the disks 27.2 drive the vertical link rods 27.1 either upward or downward.

When the vertical link rods 27.1 are in the clear (up) position, the conveying members 10 are clear of the lower pressing member 6, such that the belts 12 can convey the piles 10 in the conveying direction X.

The lower pressing member 6 comprises two lower plates 6.1 and 6.2. The lower plates 6.1 and 6.2 are adjacent and can be moved apart in the transverse direction Y so as to define a severance slot 2.0.

Figure 8:
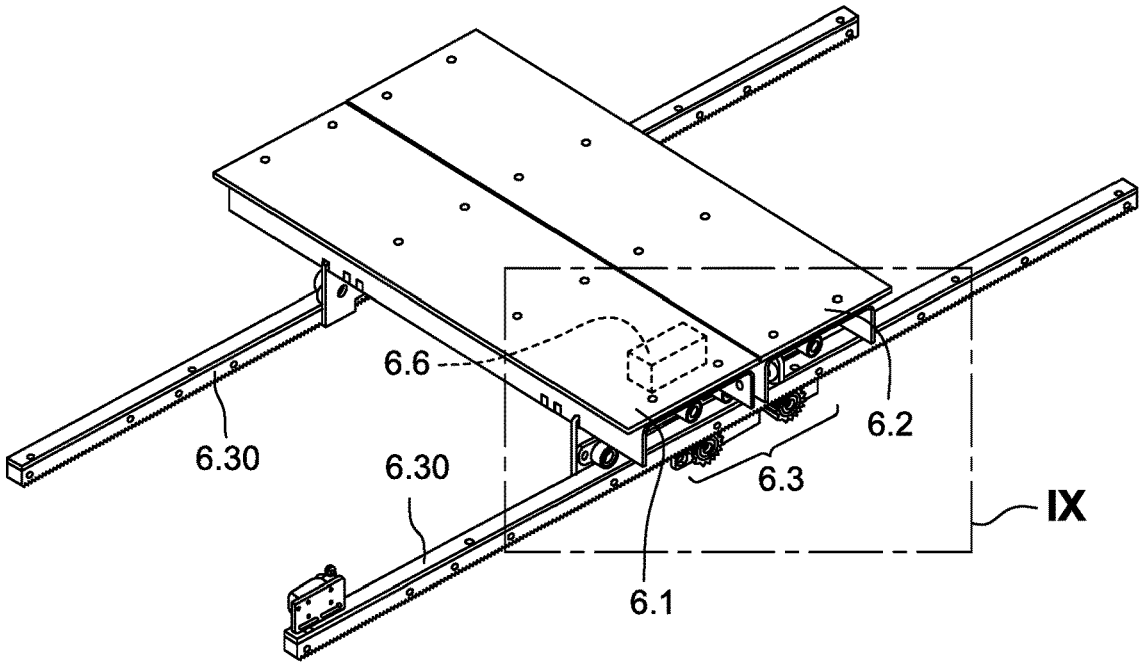
FIG. 8 is a view of a lower pressing member belonging to the severing device of FIG. 1.
Figure 9:
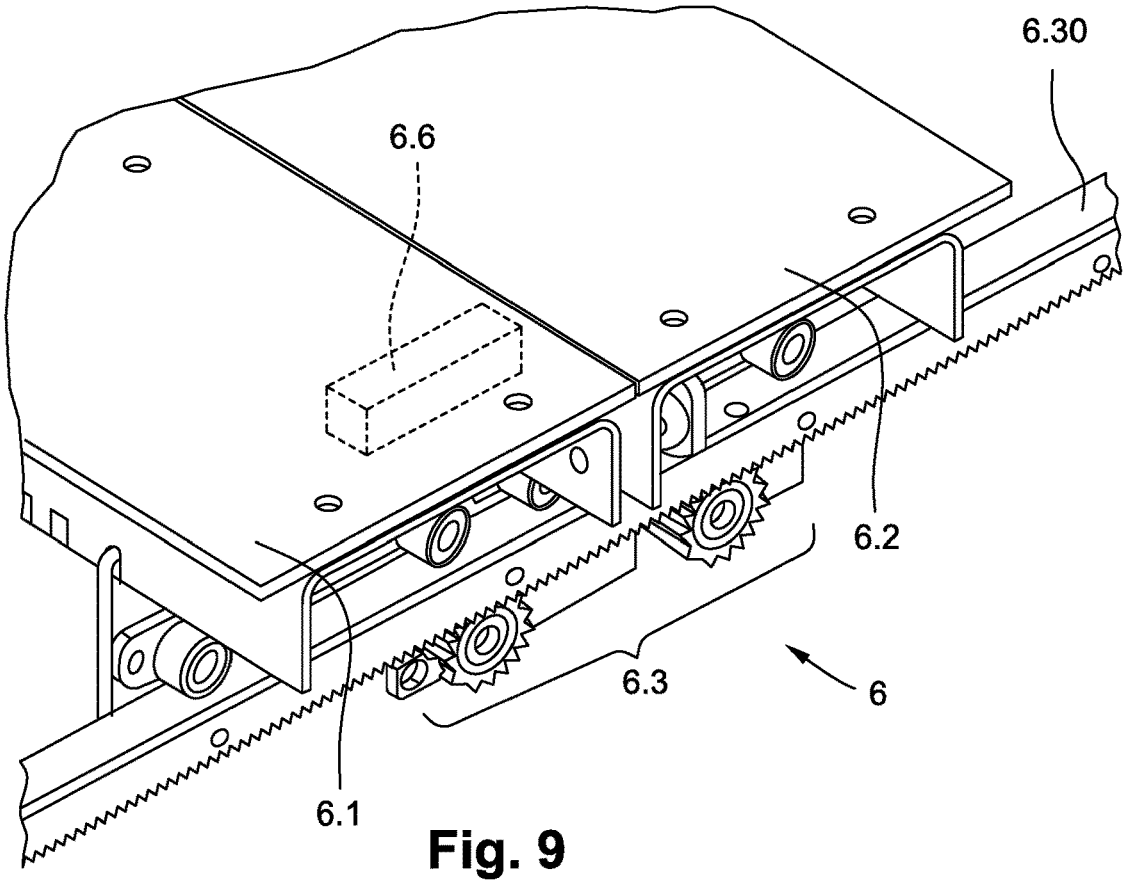
FIG. 9 is a view on a larger scale of detail IX of FIG. 8.

The lower pressing member 6 further comprises a lower translation actuator 6.3 which is arranged to move the lower plates 6.1 and 6.2 in translation in the transverse direction Y. In the example of FIGS. 8 and 9, the lower translation actuator 6.3 is made up of a rack mechanism comprising rack rails 6.30.

When the severing device 1 is in service, the lower translation actuator 6.3 moves the lower pressing member 6 so as to cause the severance slot 2.0 to coincide with a frangible line 101. The movements of the lower translation actuator 6.3 are controlled by the control unit 52.

In addition, the lower pressing member 6 comprises a lower ram 6.6, symbolized in FIGS. 8 and 9, configured to move the two lower plates 6.1 and 6.2 apart and closer together, selectively, in the transverse direction Y.

When the severing device 1 is to sever frangible lines 101, the lower ram 6.6 moves the lower plate 6.1 away from the lower plate 6.2. The lower ram 6.6 then moves the lower plate 6.1 closer to the lower plate 6.2, to return to the adjacent position. The movements of the lower ram 6.6 are controlled by the control unit 52.

Moreover, each conveying member 10 further includes coupling elements 16 and 17. The coupling elements 16 and 17 are arranged on each of the transverse faces of the rotary pinions 14 and 15. The coupling elements 16 and 17 are configured to collaborate with coupling elements of the juxtaposed conveying member 10. The severing device 1 further comprises a rotary actuator, not depicted, configured to drive the rotation of the rotary pinions 14 and 15.

The severing device 1 further comprises a clutch system 30 which is configured to move the juxtaposed conveying members 10 closer together translationally in the transverse direction Y. The clutch system 30 "re-engages" or re-couples the respective rotary pinions 14 and 15 with the respective coupling elements 16 and 17.

The clutch system 30 thus allows the conveying members 10 to be returned to the initial position after the lower plates 6.1 and 6.2 have parted the conveying members 10 so as to sever a frangible line in the pile 100 of stacked sheets of cardboard. When the conveying members 10 are in the initial position, all their rotary pinions 14 and 15 are engaged with the coupling elements 16 and 17, allowing all the belts 12 to be turned simultaneously.

The clutch system 30 comprises:

i) two guide rails 32 running parallel to the transverse direction Y, ii) carriages 34 designed to slide respectively along the guide rails 32, each carriage 34 being configured to support a respective conveying member 10, iii) two electromechanical clutches 38 configured to move the carriages 34 along the rails 32.

In the example of FIGS. 10 and 11, each electromechanical clutch 38 comprises a pivoting bar 38.1 the ends of which are fitted with rollers. The clutch system 30 further comprises a vertical linear actuator 31 which is designed to move one end of the pivoting bar 38.1 in translation parallel to the vertical direction Z.

A first end of the pivoting bar 38.1 is in contact with the vertical linear actuator 31. The other end of the pivoting bar 38.1 is in contact with the first conveying member 10 (on the left in FIGS. 10 and 11).

The pivoting bar 38.1 is designed here to pivot through an angle A38.1 approximately equal to 30 degrees, thereby causing the first conveying member 10 to move horizontally by approximately 15 mm to the right in the transverse direction Y.

When the severing device 1 and the manufacturing plant 51 are in service, the control unit 52 notably performs the following steps:

receiving a signal indicating the position of at least one incoming frangible line in the transverse direction Y, commanding the upper pressing member 2 to move from the clear position to the immobilizing position, so as to immobilize the pile, commanding the conveying members 10 to move from the clear positions to the immobilizing positions, so as to immobilize the pile, and parting the upper plates 2.1, 2.2 and the lower plates 6.1 and 6.2 in the transverse direction Y, so as to sever the attachment zones that define the at least one frangible line 101.

Next, the control unit 52 notably performs the following step: commanding the vertical linear actuators 31 so as to move the conveying members 10 translationally in the transverse direction Y. In the case of the two conveying members 10 that had previously been parted, the rotary pinions 14 and 15 respectively re-engage with the coupling elements 16 and 17. Thus, the severing device 1 is once again ready to sever a frangible line 101.

Of course, the present invention is not restricted to the particular embodiments described in the present patent application, or to embodiments within the competence of a person skilled in the art. Other embodiments may be envisioned without departing from the scope of the invention, on the basis of any element equivalent to an element indicated in the present patent application.

The invention claimed is:

1. A severing device, for severing attachment zones defining frangible lines on stacked sheets of cardboard forming a pile, the severing device comprising:

an upper pressing member which is mobile at least between:

a first immobilizing position, in which the upper pressing member applies pressure to a top sheet of the pile, so as to immobilize the pile, and a clear position, in which the upper pressing member is arranged to be distant from the top sheet of the pile, the upper pressing member comprising at least two adjacent upper plates configured to move apart; and a support part configured to support the pile on the support part when the upper pressing member is in the first immobilizing position, the support part comprising a plurality of conveying members configured to convey and move the pile in a conveying direction;

the plurality of conveying members are juxtaposed in an array in a direction transverse to the conveying direction; each of several of the conveying members including:

a belt extending parallel to the conveying direction, and the belt is configured to drive the pile in the conveying direction, and at least one rotary pinion located and configured to drive the belt in a belt circuit to drive the pile in the conveying direction; and a lower pressing member arranged under the conveying members and comprising at least one disk connected to a link rod, the at least one disk and link rod configured to move the conveying members vertically at least between:

a second immobilizing position, in which the lower pressing member applies pressure to undersides of the conveying members so that the conveying members cooperate with the upper pressing member to immobilize the pile; and a clear position, in which the lower pressing member is arranged to be distant from the undersides of the conveying members;

the lower pressing member comprising two adjacent lower plates configured to be moved apart;

an upper translation actuator configured to move the upper pressing member relative to the support part, in translation, and in the transverse direction, to cause a severance slot defined by the adjacent upper plates to coincide with a frangible line;

a lower translation actuator comprising a rack mechanism comprising rack rails arranged to move the lower pressing member relative to the support part, in translation, and in the transverse direction, so as to cause the severance slot to coincide with the frangible line, wherein, in the first immobilizing position and the in the second immobilizing position, the adjacent upper plates are configured to move apart in translation, and in the transverse direction, and the adjacent lower plates of the lower pressing member are arranged to move apart in translation, and in the transverse direction, to cause the severance of the stacked sheets along the frangible line.

2. A severing device according to claim 1, wherein the number of conveying members is greater than eight.

3. A severing device according to claim 1, wherein each conveying member is configured to be moved in the transverse direction with respect to a juxtaposed conveying member.

4. A severing device according to claim 1, wherein several of the conveying members each have a width between 50 mm and 500 mm, measured in the transverse direction.

5. A severing device according to claim 1, wherein the upper pressing member is configured to move between the first immobilizing position and the clear position, the moving being in a substantially vertical direction when the severing device is in a service configuration, and wherein the conveying members are configured to be moved between the first immobilizing positions and the clear positions in a substantially vertical direction when the severing device is in the service configuration.

6. A severing device according to claim 1, wherein the upper pressing member comprises a pivoting part, and the severing device further comprises a pivoting actuator configured to drive the pivoting part about a direction of pivoting parallel to the transverse direction, so as to sever attachment zones defining frangible columns in the sheets of cardboard of the pile, wherein the frangible columns extend transversely to the frangible lines.

7. A severing device according to claim 1, wherein the upper pressing member comprises an upper ram configured to move the two upper plates both apart and closer together in the transverse direction, and wherein the lower pressing member comprises a lower ram configured to move the two lower plates apart and closer together in the transverse direction.

8. A severing device according to claim 1, wherein several of the conveying members each further include respective coupling elements arranged on each of transverse faces of each rotary pinion, and the coupling elements are selectively configured to collaborate or not to collaborate with the coupling elements of the juxtaposed conveying member, a rotary actuator being configured to drive the rotation of the rotary pinions.

9. A severing device according to claim 1, further comprising a clutch system configured to move the conveying members translationally closer together in the transverse direction.

10. A severing device according to claim 9, wherein the clutch system further comprises:

i) at least one guide rail extending parallel to the transverse direction;

ii) carriages configured to slide on the at least one guide rail, each carriage being configured to support a respective conveying member; and iii) at least one electromechanical clutch configured to move a conveying member so as to move the carriages along the at least one rail.

11. A severing device according to claim 10, wherein the at least one electromechanical clutch comprises a pivoting bar configured to pivot and by such pivoting to cause the conveying member to move horizontally in the transverse direction.

12. A severing device according to claim 1, wherein the upper pressing member comprises upper plates that are movable apart and the lower plates are movable apart so as to sever the attachment zones defining the at least one frangible line when the upper pressing member and the conveying members are in their respective immobilizing positions.

13. A manufacturing plant for manufacturing collapsible boxes, the manufacturing plant comprising:

i) a severing device according to claim 1; and ii) a control unit configured to:

receive a signal indicating the position of at least one incoming frangible line in the transverse direction;

command the upper pressing member to move from the clear position into the immobilizing position, so as to immobilize the pile;

command the conveying members to move from the clear positions into the immobilizing positions, so as to immobilize the pile; and parting the upper plates and the lower plates in the transverse direction so as to sever the attachment zones defining the at least one frangible line when the upper pressing member and the conveying members are in their respective immobilizing positions.

* * * * *